US006185279B1

(12) United States Patent
Chambron

(10) Patent No.: US 6,185,279 B1
(45) Date of Patent: Feb. 6, 2001

(54) CASING FOR ELECTROMAGNETIC RADIATION SOURCE AND METHOD FOR ELIMINATING EXTRAFOCAL ELECTROMAGNETIC RADIATION

(75) Inventor: Edmond Chambron, Monterblanc (FR)

(73) Assignee: GE Medical Systems SA (FR)

( * ) Notice: Under 35 U.S.C. 154(b), the term of this patent shall be extended for 0 days.

(21) Appl. No.: 09/194,501

(22) Filed: Nov. 19, 1998

Related U.S. Application Data

(63) Continuation of application No. PCT/FR97/00880, filed on May 20, 1997.

(30) Foreign Application Priority Data

May 20, 1996 (FR) ..... 96/06228

(51) Int. Cl.[7] ..... G21K 1/00

(52) U.S. Cl. ..... 378/161; 378/140; 378/160; 378/150

(58) Field of Search ..... 378/161, 160, 378/140, 150

(56) References Cited

U.S. PATENT DOCUMENTS 4,541,107 9/1985 Rossi ..... 378/146
4,856,042 * 8/1989 Staron et al. ..... 378/150

FOREIGN PATENT DOCUMENTS 056552 7/1982 (EP) .
239882 10/1987 (EP) .
438147 11/1935 (GB) .
2005911 4/1979 (GB) .

* cited by examiner

*Primary Examiner*—Craig E. Church
(74) *Attorney, Agent, or Firm*—Jay L. Chaskin

(57) ABSTRACT

A casing for an electromagnetic radiation source includes a window made of a material that is transparent to the radiation emitted by the source and which includes at least one chamber in which a material that is opaque to electromagnetic radiation can move. The chamber is designed such that the material that is opaque to radiation can be introduced from the exterior of the chamber. Inside the chamber, the material that is opaque to radiation surrounds a region for passage of a radiation beam such that the area of the beam passage region varies as a function of the volume of opaque material in the chamber, by virtue of which parasitic extrafocal radiation is eliminated from the beam.

23 Claims, 3 Drawing Sheets

CASING FOR ELECTROMAGNETIC RADIATION SOURCE AND METHOD FOR ELIMINATING EXTRAFOCAL ELECTROMAGNETIC RADIATION

This is a continuation application of International Application No. PCT/FR97/00880 filed May 20, 1997.

BACKGROUND OF THE INVENTION

The present invention relates to a casing for an electromagnetic radiation source, in particular an X-ray source, which includes a window making it possible to eliminate extrafocal radiation.

The invention is quite particularly applicable, in the medical field, to X-ray imaging devices.

As shown in FIG. 1, which represents the part of the window of an X-ray source of the prior art, the X-ray source comprises a cathode 10 and an anode 11 which are contained in a casing 12 that is transparent to X-rays. The assembly comprising of the cathode 10, the anode 11 and the casing 12 is in turn contained in a casing 13 that is opaque to X-rays, with the exception of a part located facing the X-ray beam emitted by the anode 11, which comprises of a window 15 made of material that is transparent to X-rays. The gap between the transparent casing 12 and the opaque casing 13 is filled by oil 16 used for insulation and for cooling the X-ray source.

As is well-known, the cathode 10 emits electron radiation which strikes the rotating anode 11 which re-emits an X-ray beam from a focal surface. The X-ray beam emitted by the anode 11 comprises radiation output by this focal surface, and also extrafocal parasitic radiation. This extrafocal parasitic radiation must be eliminated, preferably as close as possible to the emission source.

Conventionally, in order to eliminate this extrafocal radiation, as shown in FIG. 1, a conical element 30 or diaphragm made of material that is opaque to X-rays, for example made of lead, and provided with a central opening 31 for passage of the X-ray beam was provided. The diameter of the opening 31 is a compromise between obtaining a wide field and eliminating extrafocal radiation. However, in some cases, it was desirable to obtain smaller fields, for example by using a smaller focal surface. However, in this case, the diameter of the opening 31 is no longer adapted to the emitted X-ray beam and, in particular, no longer eliminates the extrafocal radiation. Conventionally, use was then made, in order to eliminate the extrafocal radiation, of extrafocal fingers 32, made of material that is opaque to X-rays, for example made of lead, which were brought into position both laterally and longitudinally by a rod system 33, in accordance with the desired field. Such a system is mechanically complex, expensive and furthermore does not make it possible to collimate the X-ray beam as close as possible to the focus.

BRIEF SUMMARY OF THE INVENTION

It is therefore desirable to provide a casing for an electromagnetic radiation source, in particular an X-ray source, which makes it possible to do without the conical element or diaphragm and the extrafocal fingers for eliminating the extrafocal radiation.

In an embodiment of the invention a casing for an electromagnetic radiation source, in particular an X-ray source, comprises a window made of a material that is transparent to electromagnetic radiation, the window comprising at least one chamber in which a material that is opaque to electromagnetic radiation can move, this chamber being designed in such a way that the opaque material can be introduced from the exterior of the chamber and that, inside the chamber, this opaque material surrounds a region for passage of an electromagnetic radiation beam in such a way that the area of the radiation passage region varies as a function of the volume of opaque material in the chamber, by virtue of which parasitic extrafocal radiation is eliminated from the beam.

The present invention also relates to a method for eliminating the extrafocal radiation from an electromagnetic radiation beam by using a window in a casing of an electromagnetic radiation source as defined above.

DETAILED DESCRIPTION OF THE INVENTION

Figure 1:
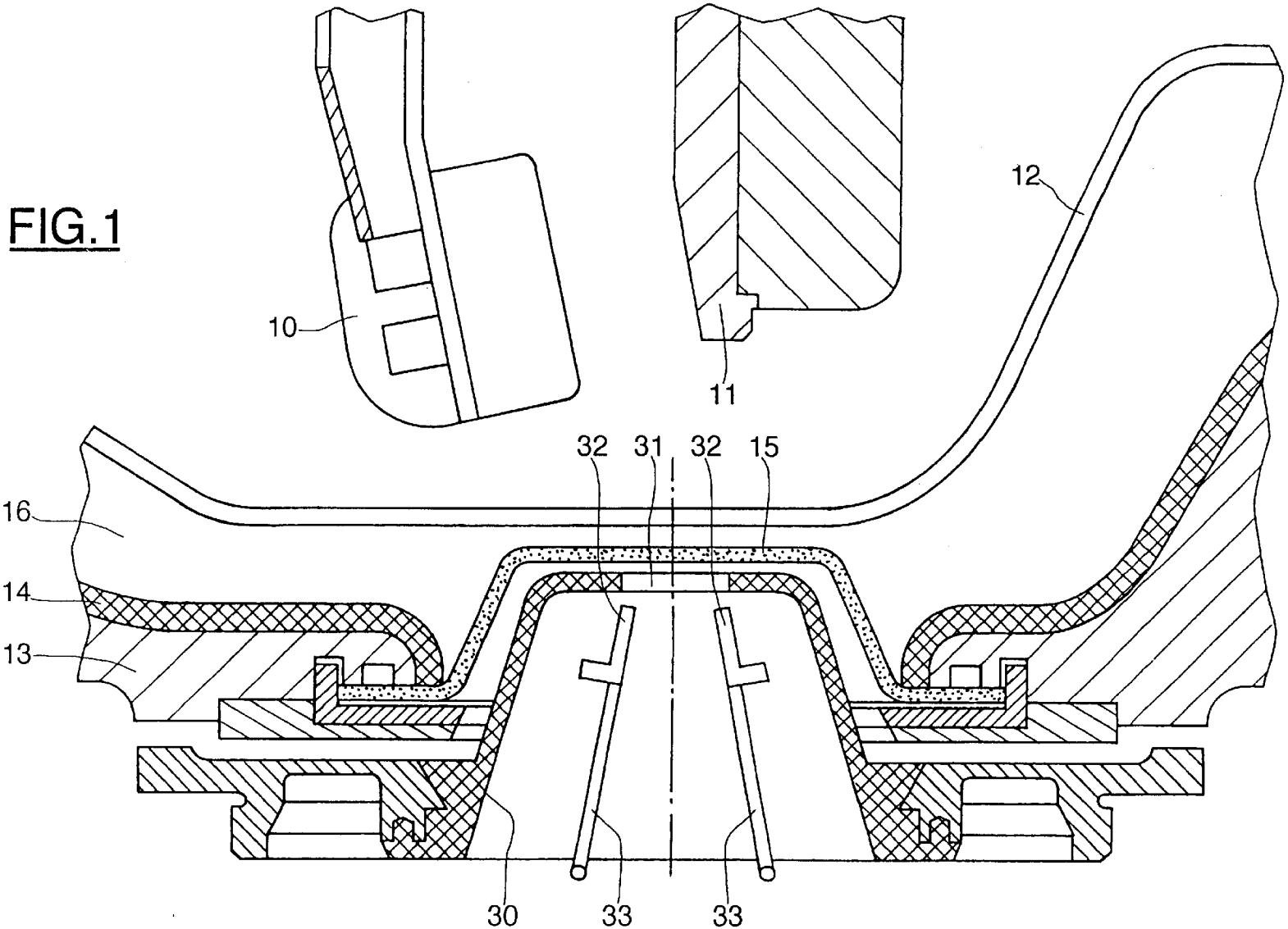
FIG. 1 is a partial view of the region of the window of an X-ray source, as well as the diaphragm and the system for eliminating extrafocal radiation, of an X-ray source of the prior art.

FIG. 1 represents the X-ray emission part of an X-ray source of the prior art as well as the part of the diaphragm from this source. Conventionally, the X-ray source comprises a cathode 10 and a rotating anode 11 which are contained in a casing 12 that is transparent to X-rays. The assembly is itself closed in a casing 13 provided with a skirt 14 made of material that is opaque to X-rays, for example made of lead, with the exception of a region located facing the anode 11, which consists of a window 15 made of a material that is transparent to X-rays. The gap between the casing 12 and the protective casing 13 and the window 15 is filled with oil which ensures cooling and high-voltage electrical insulation of the X-ray source. Consequently, the casing 13 must provide sealing with respect to the oil contained in the gap between this casing 13 and the casing 12 and also ensure that the X-radiation beam will only be emitted through the window 15.

As is well known, the cathode 10 emits an electron beam which strikes the focal track of the rotating anode 11 which in turn emits an X-ray beam towards the window 15.

As shown by FIG. 1, conventionally, the X-ray beam emitted by the anode 11 is shaped by means of a diaphragm 30 made of a material that is opaque to X-rays, the opening 31 of which is dimensioned in order to obtain an X-radiation beam output by the focus of the anode and to intercept the X-radiation emitted by the source outside the focus, or extrafocal radiation. The parasitic extrafocal radiation should be eliminated because it impairs the quality of the image subsequently obtained. It is furthermore desirable to be capable of varying the dimension of the focal surface of the anode and consequently the geometry of the X-ray beam. Therefore, in order to eliminate the extrafocal radiation, it is necessary to modify the dimension of the opening of the diaphragm 30 as a function of the dimension of the focal surface as well as the collimation of the X-ray beam. Conventionally, in order to adapt the opening of the diaphragm 30 to the X-ray beam and to be able to eliminate the extrafocal radiation, moving fingers 32, made of a material that is opaque to X-rays, are provided and are manipulated by means of a complex rod system 33 in order to dimension the opening 31 as a function of the focal area and the desired area for the final image. This arrangement of the prior art, which has just been described, has several drawbacks. Firstly, since the diaphragm 30 is a separate part from the window 15, it must be placed externally to this window and it is therefore not possible to eliminate the extrafocal radiation as close as possible to the focal surface for emitting the X-ray beam. With regard to the quality of the final image obtained, it is particularly beneficial to be able to eliminate the extrafocal radiation as close as possible to the focal surface of the source. Furthermore, the use of opaque fingers 32 requires a complex mechanical rod system 33 for dimensioning the opening 31 of the X-ray beam diaphragm.

In an embodiment of the invention, these drawbacks are overcome by providing a window which is also used as a diaphragm for eliminating the extrafocal radiation. By virtue of the fact that the window itself fulfills the function of a diaphragm, it is possible to place this diaphragm closer to the focal surface of the X-ray beam.

Furthermore, the window of one embodiment of the invention permits simple dimensioning of the passage opening for the X-ray beam without requiring a complex mechanical rod system.

Figure 2:
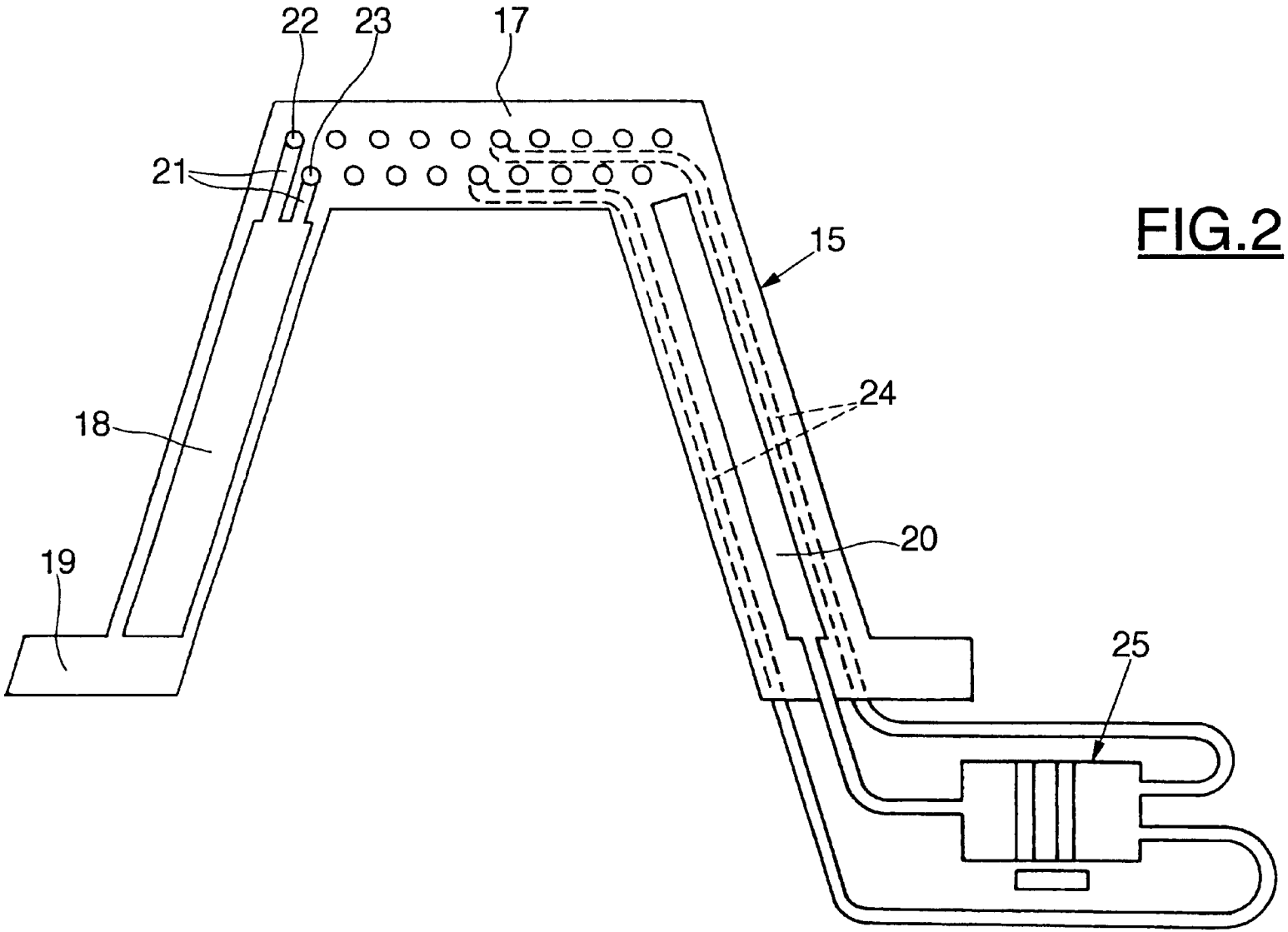
FIG. 2 is a sectional view of a window in a casing of an X-ray source of one embodiment of the invention.

FIG. 2 represents a window 15 in a casing for an X-ray source in an embodiment of the invention. This window 15 has the general shape of a frustoconical dome and has an end wall 17 and a sidewall 18 ending in a flange 19 for mounting it in the protective casing 13. This window 15 consists of a material that is transparent to X-rays. In an embodiment of the invention, this window 15 comprises an internal chamber designed to permit the displacement of an opaque material which is introduced from outside the chamber in such a way that the area of the X-ray beam passage region varies as a function of the volume of opaque material in the chamber, in order thus to eliminate the extrafocal parasitic radiation from the beam.

In a recommended embodiment, the chamber comprises a first channel wound on itself in the shape of a spiral.

Preferably, the chamber comprises a second channel in the shape of a spiral, juxtaposed with the first channel in a direction perpendicular to the planes on which the openings of the first and second channels are located, this first and this second channel being offset relative to each other in such a way that the turns of one spiral cover the space between the turns of the other spiral, so as to ensure complete opacity to radiation in the part of the spirals through which the opaque material passes.

Preferably, the electromagnetic radiation beam is an X-ray beam and the source is an X-ray source.

Figure 3:
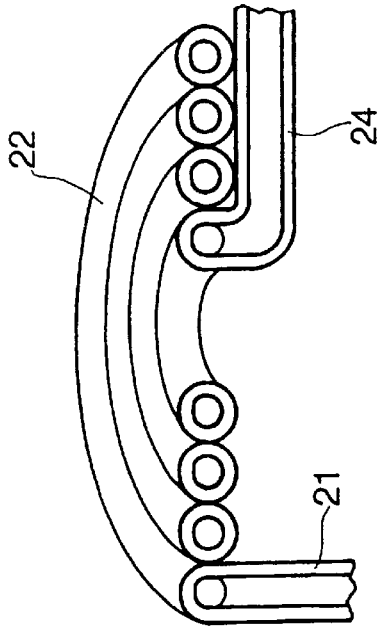
FIG. 3 is a schematic view of a spiral channel of a chamber in a window of an X-ray source of one embodiment of the invention.

In the embodiment represented, this chamber comprises an annular cavity 20 arranged in the sidewall 18 and connected at its lower end to a means 25 for controlling the displacement of the material that is opaque to X-rays. This annular chamber 20 is connected at its upper end to the outermost turn of each of two spiral channels 22, 23 arranged in the end wall 17 of the window by means of tubes 21. The spiral channels 22 and 23 are arranged in the end wall 17 in juxtaposed planes parallel to the end wall 17. As represented, the turns of the two channels 22, 23 are offset relative to one another in such a way as jointly to cover virtually the entire area of the end wall 17. Clearly, a single spiral channel could be used, preferably a spiral channel with adjoining turns, as represented in FIG. 3. Use could also be made of more than two superposed spiral channels. The innermost turn of each of these spiral channels 22 and 23 is also connected, via a conduit 24 arranged in the window, to the device for controlling the opaque material.

Clearly, it is, if so desired, possible to do without the annular cavity 20 and replace it by two conduits. The material that is opaque to X-rays, for example mercury, is introduced by means of the control device 25 into the annular chamber 20 then into the outer turns of the spiral channels 22 and 23 towards the center of these spiral channels, so as to leave a central passage of suitable dimension for the X-ray beam. The turns of the spiral channels 22 and 23, forming the central passage for the X-ray beam, are filled, also by means of the control device 25, within a liquid that is transparent to X-rays, for example alcohol. The turns of the spiral channels 22 and 23, which are filled with opaque material and surround the central turns filled with material that is transparent to X-rays, therefore form a diaphragm that is opaque to X-rays, making it possible to eliminate the extrafocal radiation. Depending on the quantity of opaque material introduced into the turns of the channels 22 and 23, it is therefore possible to dimension the central passage that is transparent to X-rays and easily to eliminate the extrafocal radiation as a function of the dimension of the focal surface of the X-ray source. Furthermore, since the diaphragm function is fulfilled in the window of the outer casing of the X-ray source itself, it is possible to achieve this elimination of the extrafocal radiation very close to the focal surface of the source.

Figure 4:
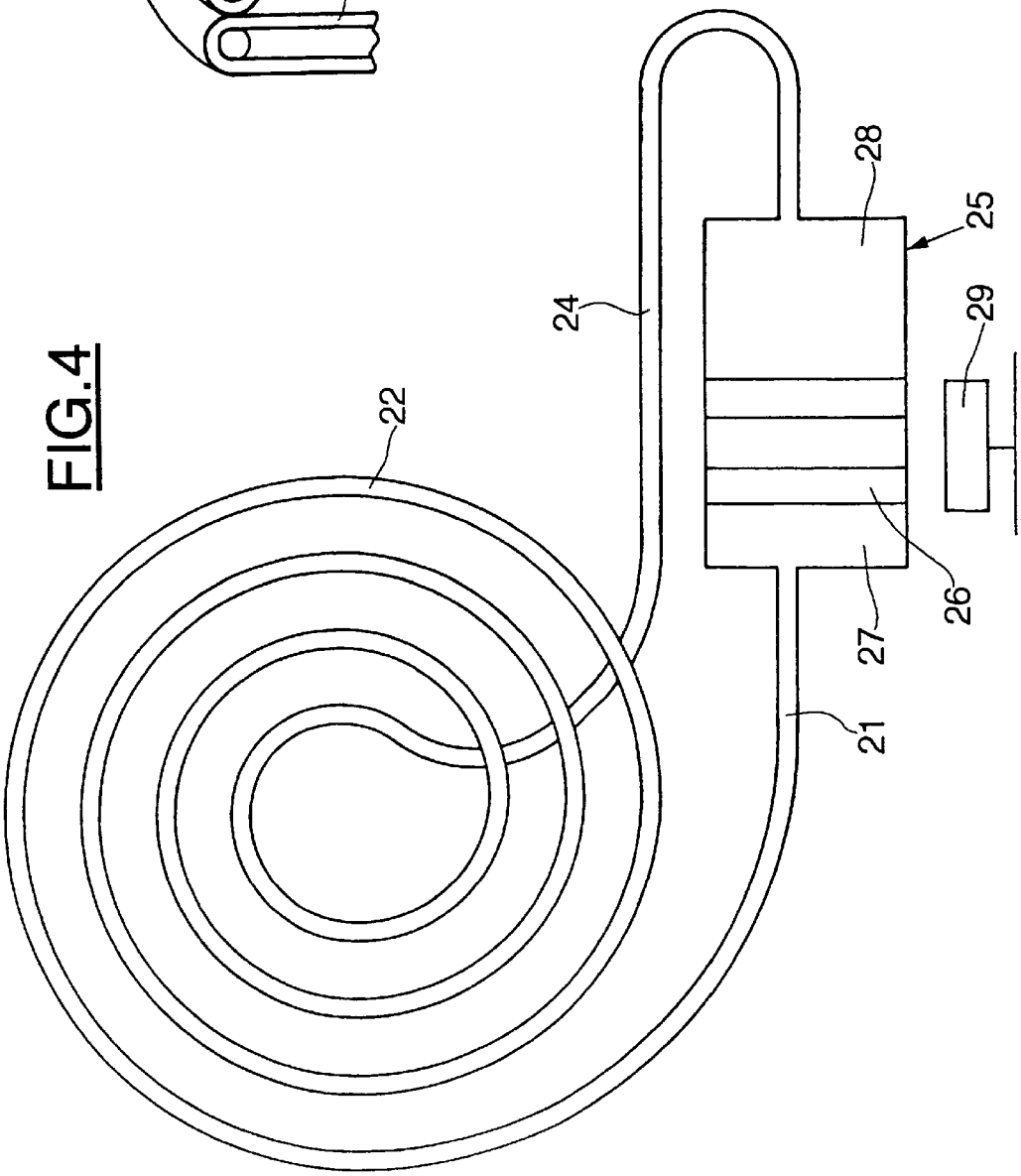
FIG. 4 is a schematic view of a spiral channel of a window in a casing of an X-ray source of one embodiment of the invention, connected to a device for controlling the displacement of the material that is opaque to X-rays.

FIG. 4 schematically represents a spiral channel connected to a device for controlling the displacement of the opaque material 25, which is particularly recommended for the present invention. This control device 25 comprises an enclosure in which a piston 26 is arranged, this piston being movable in translation and dividing the enclosure into a first chamber and a second chamber 28. The first chamber 27 is connected by a conduit 21 to the outer turn, for example, of the spiral channel 22. The second chamber 28 is itself connected by a conduit 24 to the innermost turn, for example, of the spiral channel 22. The chamber 27 is filled with material that is opaque to X-rays, for example mercury, whereas the chamber 28 is filled with a material that is transparent to X-rays, for example alcohol. The piston 26 may, for example, be a piston that is movable by means of a magnet 29. As represented, the piston 26 includes two movable magnetic plates, separated from each other, to define a space that is generally filled with air for the purpose of taking up thermal expansion. As is immediately clear, when the magnet is moved either to the right or to the left, the piston 26 is also moved, either to the right or the left, thus introducing into the spiral channel 22 more or less of the product that is opaque to X-rays. It is thus easily possible to dimension the central passage for the X-ray beam and eliminate the extrafocal parasitic radiation in accordance with the purpose intended for the X-ray source. It is also possible to use, instead of the device described above, a peristaltic pump as the device for controlling displacement of the material that is opaque to X-rays.

Various modifications in structure and/or function and/or steps may be made by one skilled in the art without departing from the scope and extent of the invention.

What is claimed is:

1. Casing for electromagnetic radiation source, comprising a window made of a material which is transparent to the radiation emitted by the source, wherein that the window comprises at least one chamber in which a material that is opaque to electromagnetic radiation can move, this chamber being designed in such a way that the material that is opaque to radiation can be introduced from the exterior of the chamber and that, inside the chamber, this material that is opaque to radiation surrounds a region for passage of a radiation beam in such a way that the area of the beam passage region varies as a function of the volume of opaque material in the chamber, by virtue of which parasitic extrafocal radiation is eliminated from the beam.

2. Casing according to claim 1 wherein that the chamber comprises a first channel wound on itself in the shape of a spiral.

3. Casing according to claim 2 wherein the chamber comprises a second channel in the shape of a spiral, juxtaposed with the first channel in a direction perpendicular to the planes on which the openings of the first and second channels are located, this first and this second channel being offset relative to each other in such a way that the turns of one spiral cover the space between the turns of the other spiral, so as to ensure complete opacity to radiation in the part of the spirals through which the opaque material passes.

4. Casing according to claim 1 wherein a part of the volume of the chamber is occupied by the material that is opaque to radiation and the remaining volume is occupied by a fluid that is transparent to radiation.

5. Casing according to claim 2 wherein a part of the volume of the chamber is occupied by the material that is opaque to radiation and the remaining volume is occupied by a fluid that is transparent to radiation.

6. Casing according to claim 3 wherein a part of the volume of the chamber is occupied by the material that is opaque to radiation and the remaining volume is occupied by a fluid that is transparent to radiation.

7. Casing according to claim 4 wherein the material that is opaque to radiation is contained at the periphery of the chamber and the fluid that is transparent to radiation is contained at its center.

8. Casing according to claim 5 wherein the material that is opaque to radiation is contained at the periphery of the chamber and the fluid that is transparent to radiation is contained at its center.

9. Casing according to claim 6 wherein the material that is opaque to radiation is contained at the periphery of the chamber and the fluid that is transparent to radiation is contained at its center.

10. Casing according to claim 1 wherein the material that is opaque to radiation is liquid mercury.

11. Casing according to claim 4 wherein the fluid that is transparent to radiation is alcohol.

12. Casing according to claim 11 wherein the fluid that is transparent to radiation is alcohol.

13. Casing according to claim 1 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

14. Casing according to claim 2 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

15. Casing according to claim 3 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

16. Casing according to claim 4 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

17. Casing according to claim 5 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

18. Casing according to claim 6 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

19. Casing according to claim 7 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

20. Casing according to claim 10 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

21. Casing according to claim 11 wherein the window has the shape of a frustoconical dome having an end wall and a sidewall, the chamber comprising at least one channel wound in a spiral, arranged in the end wall, and an annular cavity, arranged in the sidewall and communicating with the spiral channel(s).

22. Casing according to claim 1 wherein the electromagnetic radiation source is an X-ray source.

23. Method for eliminating the extrafocal radiation from a beam of electromagnetic radiation emitted by a source, comprising the steps of providing a casing of the electromagnetic radiation source with a window having a chamber and introducing into the chamber the desired quantity of radiation-opaque material to absorb the extrafocal radiation.

* * * * *